United States Patent [19]

Frank

[11] Patent Number: 4,510,957

[45] Date of Patent: Apr. 16, 1985

[54] RESILIENT SUPPORT FOOT FOR WALKING AIDS, PARTICULARLY CRUTCHES

[75] Inventor: Xaver Frank, Lengenwang, Fed. Rep. of Germany

[73] Assignee: S & F Orthopädietechnik GmbH, Görisried, Fed. Rep. of Germany

[21] Appl. No.: 402,594

[22] Filed: Jul. 28, 1982

[30] Foreign Application Priority Data

Aug. 5, 1981 [DE] Fed. Rep. of Germany ..... 3131027
Mar. 30, 1982 [DE] Fed. Rep. of Germany ..... 3211732

[51] Int. Cl.[3] ..... A45B 9/04

[52] U.S. Cl. ..... 135/84; 135/79; 135/86

[58] Field of Search ..... 135/77, 78, 79, 80, 135/81, 82, 84, 86, 69

[56] References Cited

U.S. PATENT DOCUMENTS

| | | | |
|---|---|---|---|
| 108,303 | 10/1870 | Tuttle | 135/84 |
| 679,468 | 7/1901 | Pratt | 135/84 |
| 710,074 | 9/1902 | Pratt | 135/84 |
| 730,466 | 6/1903 | Maass | 135/79 |
| 765,984 | 7/1904 | Morris et al. | 135/84 |
| 2,910,995 | 11/1959 | Jacuzzi | 135/77 |
| 3,486,515 | 12/1969 | Chrysostomides | 135/69 |
| 3,901,258 | 8/1975 | Montgomery | 135/81 X |

FOREIGN PATENT DOCUMENTS

| | | | |
|---|---|---|---|
| 477182 | 9/1951 | Canada | 135/79 |
| 1566505 | 11/1970 | Fed. Rep. of Germany | 135/78 |
| 179464 | 5/1922 | United Kingdom | 135/77 |

*Primary Examiner*—Robert A. Hafer
*Assistant Examiner*—Arnold W. Kramer
*Attorney, Agent, or Firm*—Handal & Morofsky

[57] ABSTRACT

A support foot for walking aids, in particular crutches is presented, comprising a sole body which is fixed to a support plate anchored in articulated fashion to the support shaft. The support plate comprises a bordering skirt embodied as a universal plug socket to receive a standardized guide section of different sole bodies which are secured releasably in the bordering skirt by locking pins penetrating the same. The design of the support foot is such that it gives the handicapped a degree of safety unattained before and, furthermore, permits a conventional walking aid to be modified at very little expenditure for the handicapped so that it will be adapted in optimum manner to the respective surroundings.

32 Claims, 15 Drawing Figures

Fig.8
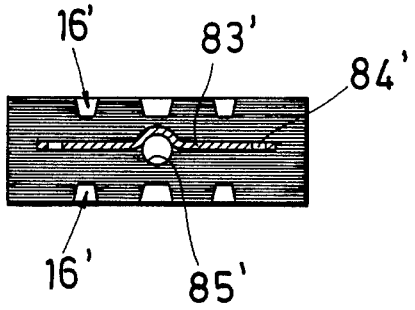
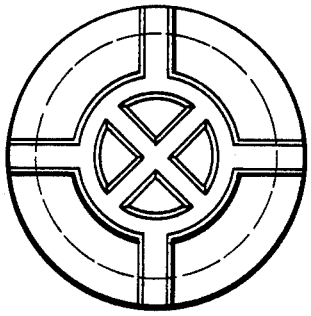
Fig.9
Fig.10
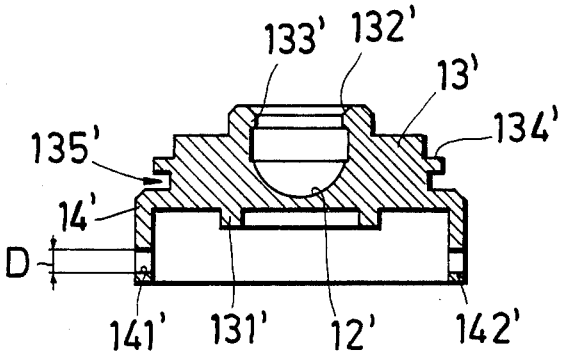

RESILIENT SUPPORT FOOT FOR WALKING AIDS, PARTICULARLY CRUTCHES

The instant invention relates to a resilient support foot for walking aids, in particular crutches, comprising a sole body which establishes contact with the ground and is supported, at the end remote from the tread surface, at a support plate comprising, at its lower end, a bordering skirt destined to give lateral support to the sole body and a peg attached to its upper end and linked by joint means to the support shaft of the walking aid.

In such a support foot as known, e.g. from German Patent No. 341 874, the sole body is fixed in position, as shown in FIG. 3, by an inwardly bent bordering skirt which penetrates into the surface of the jacket of a rubber-elastic block when the sole is assembled. The sole body itself has smooth surfaces which are pressed onto the ground, on the one hand, and against the support plate, on the other hand.

It is a disadvantage of this known support foot that the rubber-elastic sole body can be fixed only by positively deforming the same so that the block not only is difficult to insert and replace, an action requiring force, but also is maintained under extreme local stress of the material of the sole body. This undue stressing of the block caused by the assembly and design of the same reduces its lifetime quite considerably, all the more so as the bordering skirt engages with the surface of the jacket of the elastic sole body during the entire life of the walking aid, thus maintaining the notching effect from the very beginning. This type of skirting which is unfavorable for the sole body not only reduces the lifetime of the support foot but also is disadvantageous in that the fixing is not or does not remain fully reliable as the sole body is deformed repeatedly under the dynamic load acting on the same so that it will show signs of fatigue slowly but surely in the area of its jacket. After a certain number of load cycles, therefore, the function of retention no longer can be fulfilled safely.

For this reason it is suggested in U.S. Pat. No. 3,335,735 that the sole body be connected permanently to the support plate. This, however, has the disadvantage that it becomes relatively expensive to produce the support foot and later on replace the worn sole because this involves an exchange of the support plate together with the ball joint half formed integral with the same.

It is, therefore, an object of the invention to provide a resilient support foot for walking aids which has a prolonged lifetime. It is a further object of the invention to provide an absolutely reliable retention of the resilient support foot on the support shaft of the walking aid. It is a further object of the invention to provide a walking aide which increases the safety of moving in any desired surroundings of the handicapped who has to rely on his crutch and, at the same time, may enjoy the appropriate easy handling offered.

This object is met in that the sole body is fitted loosely in the bordering skirt designed as a universal plug socket to receive a standardized guide section of different sole bodies each secured releasably in the bordering skirt by fastening means penetrating the same.

The invention offers the handicapped a ready opportunity of breaking the connection between the sole body and the support plate of the support foot of the walking aid by a few manipulations so as to modify it in practically no time in order to adapt it in optimum manner to the respective surroundings in which the handicapped wishes to move. The articulated mounting of the support plate is a favourable aspect of the solution of the invention because the sole body, remaining in unchanged relative position with respect to the ground during the entire relatively complicated course of movements is loaded in well defined manner and subjected mainly to pressure only. A maximum of supporting surface area always is available. The articulated connection between the sole body and the support shaft of the walking aid permits the sole body to transmit the thrust bearing reaction force more uniformly even in difficult, for example undulated terrain. For this reason the connection between the sole body and the support plate need not be as intimate as heretofore required. It is quite sufficient for the sole body to merely abut against the support plate and for the fastening means merely to retain it against forces tending to pull off the sole body. The fastening means do not subject the sole body to any compulsive forces which, on the one hand, might impair the lifetime of the sole body and, on the other hand, could cause difficulties in assembling and disassembling the sole body. In this way the sole body is free of any tensions in any respect so that the handicapped will find it very easy to exchange the sole body. This advantageous effect is enhanced still further by the fact that the releasable fastening means are disposed at an easily accessible location guaranteeing comfortable handling by the handicapped.

If the handicapped carries along different sole bodies which can be received in a universal plug socket of the support plate he may safely enter into areas not accessible for him so far. For walking on even, firm ground, for example, the user may insert a rubber-elastic, very flexible body, for walking on ice, he may use a sole body provided with steel pins, and for walking on very soft ground he may apply a sole body having an increased support surface area. This opens up new ranges of life to the handicapped, the inventive concept making it possible to keep the price therefore as low as possible.

If the bordering skirt has the shape of a hollow cylinder into which the guide section of the respective sole body is fitted loosely, this provides the specific advantage that the conditions of support can be kept the same under any circumstances due to the configuration in symmetry with the axis. In this event a ball joint connection suggests itself as the means of articulation since it has the advantage that the connection can be realized with three degrees of freedom having a single functional surface. On the other hand, this further embodiment permits the sole body to be produced with a guide surface or centering face which has a simple geometric design and can be produced economically and, moreover, facilitates the insertion of the sole body in the bordering skirt.

If the sole body is a rubber-elastic block in the form of a turn-over body having at both sides, a profile provided with calks, the contour of which is adapted to the support face of the support plate, the following specific advantages are obtained: The joint connection means in combination with the rubber-elastic block makes it possible for this sole body to follow the shape of the ground as closely as possible without any disadvantageous effect of the transfer of force to the support shaft of the walking aid. For this reason it is almost impossible for the support foot to slide on the ground so that the handicapped, using such a support foot, can move with complete security even in the most difficult terrain. The design of the sole body as a turn-over sole for instance having a levelled profile, prolongs its lifetime at least by the factor 2, i.e. provides a considerable extension of the useful life. Therefore, an exchange of the sole body, frequently required so far, will be necessary very rarely only all the more so as the monoblock being skirted and fixed at the support plate is loaded in very well defined and controlled manner so that any undue stress and the deformations resulting from the same in the plastic deformation range are excluded entirely during normal operation of the walking aid and during the process of replacement. The monoblock which is stressed very uniformly or symmetrically by virtue of the articulated suspension of the support plate and loaded mainly by pressure can resist the forces acting on the same without any difficulty because of its compact structure. The articulated suspension further prevents one-sided or uneven wear thus guaranteeing reliable and perfect transfer of pressure to the support plate even after it has been turned over. The controlled transfer of force to the sole caused by its accomodation in the support foot, moreover, permits the monoblock to be given such a profile, without weakening the stability of the support foot, that reliable adaption to the ground is obtained by an elastic displacement of the individual calks with respect to one another even if the ground is every uneven. The supporting force always will be absorbed by the entire block. In this manner the force of adherence of the support foot to the ground is increased considerably and the loads which varied greatly so far during a cycle of movements, particularly on undulated ground, are intercepted to a great extent. This all the more since, during a cycle of movement, the supporting force acting on the support foot essentially travelled over the entire supporting face. In accordance with the invention, however, the sole cannot show signs of fatigue to the same extent as before. Instead, the lifetime of the sole body is increased still further, and this is a particular advantage because, at the same time, the safety risk threatening the handicapped can be reduced even on difficult ground. The fastening means mentioned above do not exert any compulsive forces on the rubber-elastic monoblock which forces not only would affect the lifetime of the sole but also could cause difficulties in inserting and turning the sole. If the profile provided with calks and, in particular, designed to be level is provided at least at one side of the sole body with steel pins but otherwise is identical with the profile of the other side, the support foot is adapted to be modified by a few manipulations such that the handicapped will obtain an absolutely safe point of support on the ground even if the ground is smooth or covered with snow and ice. This means that the field of useful application of the walking aid can be enlarged considerably without any further accessories. This solution is particularly economical because only one sole body is required to guarantee optimum support for the most varied characteristics of the ground.

If the support plate has at least two spaced or crossing supporting webs at its underside which engage with the profile of the rubber-elastic block and by means of which the block is supported at the support plate, the conditions of support of the monoblock at the support plate will remain the same good conditions even after turning a monoblock which has been worn, for instance, at one side or uniformly. These measures further guarantee that upon turning the profile of the monoblock will project by a definite extent beyond the bordering skirt, regardless of the degree of wear. Thus after turning a monoblock which was worn at one side the support safety of the support foot is just as great as it is with an unused monoblock.

If the rubber-elastic block is retained by a locking pin diametrically passing through the support plate and extending centrally through the core of the rubber-elastic block into which a steel sleeve is vulcanized to receive the locking pin, the stability of the monoblock can be increased still further and the lifetime of the support foot becomes even longer as the metal retaining pin no longer enters into direct contact with the elastic material of the monoblock. Furthermore, the steel sleeve imparts additional rigidity to the monoblock so that signs of fatigue of the monoblock are substantially reduced.

The comfortable handling of the support foot structure according to the invention can be improved still further if the sole body is fixed to the support plate in such a manner that the sole body, while lying in surface area abutment against the support plate is releasably held in a snap-type fit in the bordering skirt of the support plate. By virtue of the snap-in connection alone, the handicapped need not take any tool to replace or turn the sole body of the support foot, a procedure which can be accomplished practically in no time, for example, if the handicapped in the wintertime returns from outside into his home where he would damage the floor, e.g. the wooden panelling if he used the foot provided with spikes. Any separation of the sole body from the support plate can be excluded and, instead, the connection between the sole body and the support plate be made absolutely reliable and impact-resistent by designing the snap-type connection suitably. A suitable design, is easy to realize as the multi-surface support of the sole in the round plate supported in articulated fashion essentially provides for pulling forces caused by adherence to be the only forces which must be transferred.

If the snap connection is provided by at least two diametrically opposed pin ends for which an annular insert hole and a downwardly open clamping slot opening are formed in the bordering skirt of the support plate, the releasable connection thus obtained fully meets the requirements as to rigidity and comfort in handling. Even after a permanent load test including 1 million load cycles this snap connection operated absolutely reliably. This solution further has the enormous advantage that the force to be applied by the handicapped to make and break this connection is very small.

Providing the pin end for the clamping slot opening with an enlarged gripping head makes the exchange or release of the sole body particularly comfortable. Furthermore, the resulting snap connection can be produced economically so that the handicapped are offered an inexpensive aid. The connection is of particular advantage if the sole is designed as a turnover body. The locking pins in this case merely must be placed in the central plane of the sole turn-over body.

The support plate designed as a round plate is reinforced by providing its support face with an annular web cooperating with a corresponding recess on the sole body. This reinforcing annular web, at the same time, is utilized in particularly advantageous manner for additional stabilization of the sole body which essentially need not be subjected to any other modification since a profiled surface of the sole normally will be required anyway. In addition, this design of the support plate provides a particularly advantageous solution for receiving a turnover sole body which has only a profile at one side and is provided additionally with spikes at the other side protruding by the extent of the profile depth from the turnover body. If the sole body is inserted with the profile surface directed to the outside, the annular web reliably prevents the spikes from being pressed into the support plate when the support foot is loaded. Consequently the support plate may be made of relatively soft material, such as plastics. Therefore, economical manufacturing methods, such as injection molding techniques may be applied. A very rigid structure is obtained by fastening the spikes to a metal plate which is vulcanized into the rubber-elastic block. This provides additional increase of the lifetime of the support foot.

The range of life of the handicapped can be widened still further if the sole body is designed as a round plate which is made of plastics, such as polyethylene, projects radially beyond the bordering skirt and is formed at its underside with a funnel-shaped recess from which profile grooves lead to the outside. The handicapped having such a sole at his disposal need not hesitate to walk on terrain closed to him before and need not fear to sink, for instance, into soft ground where he would get stuck. The articulated mounting of the support plate on the support shaft permits this design of the sole body without subjecting the same to any greater stress or one-sided rapid wear. Therefore it may be produced without any difficulty as a plastic plate. In this manner it is further guaranteed that the handicapped will not become too tired even when taking long walks in difficult terrain. This choice of material involves further economic advantages because master pattern techniques, such as casting may be employed in the manufacture.

As a rule, the snap connection described above may provide sufficient fixation also in the case of this sole body. For special safety, however, a releasable form lock by way of an additional diametrically extending locking pin might be taken into consideration. A retainer pin passing through the sole body does not make the easy handling of the support foot any worse nor does it impair the comfort in handling the same because, if difficult terrain is encountered, in this case the rapid replacement of the sole is of subordinate importance only.

If the sole body is provided in addition with a centering butt end engaging with the annular web, the presence of the annular web formed at the underside of the support plate is used advantageously for further stabilization of the sole body. Thus the annular web is given an additional centering function to fulfill.

It was described above by which means the range of life of the handicapped can be enlarged and his safety improved. Of course, in this context it must be taken into consideration that the handicapped, in the first place, must be offered a reliable and yet inexpensive solution so that the handicapped without exception may profit from the novel development described. The present invention makes use of the fact that, as a rule, the support shafts of walking aids are standardized, i.e. have fixed internal and external diameters. In accordance with a preferred further embodiment the adapter inserted between the support foot and the support shaft of the walking aid amounts to no more than a ball end pin anchored, for instance, in force fit in the support shaft. In this context a solution is conceivable according to which a slotted hollow shaft is pushed into the support tube while the individual shaft segments become deformed elastically in radial direction. Yet it is also possible to provide for other force- and form-lock anchorings of the adapter, provided that any such connection can be broken easily while, at the same time, warranting reliable fixing. Of course, the socket of the ball and socket joint may also be formed in an adapter which then will be pushed into the support shaft and secured to the same against rotation and displacement. In this event the support plate has a ball end pin attached to its top. The number of structural elements required for adaptation of a conventional walking aid is reduced to a minimum and those structural elements of the walking aid which are continued to be used need not be modified if an adapter is provided, particularly so if a ball end pin shaft is used.

If the ball end pin shaft is made of plastics, for instance, the pairing obtained for the releasable fitting of the adapter in the support shaft is very reliable. Apart from the cost factor this selection of material provides an additional advantage in that the ball, if formed integral with the shaft, may be linked simply in snap connection with the socket or spherical segment. This snap connection is subjected to relatively little loading and the force is transmitted in such defined manner that such a snap connection may be selected without any doubt as regards its functional reliability.

Providing a stabilizing spring means between the support plate and the adapter, for instance between the ball end pin and the support shaft of the walking aid, affords the additional advantage that the support plate may be placed with its entire surface on the ground even if the crutch is moved quickly in forward direction and accelerated. There is no prolonged pendulating motion of the support foot about the easily movable joint which might render this process more difficult. A special advantage is achieved by this stabilizing spring means if a sole body protruding relatively far in radial direction beyond the bordering skirt is inserted into the universal plug socket.

A particularly advantageous solution is obtained if the spring means is formed by a hose-like elastic bellows shielding the articulated connecting means from the surroundings. Thus the most simple structural measures are used to improve the operational reliability of the articulated connection means so that the walking aid may be used reliably, for instance, even in swampy areas. Furthermore, a longer lifetime of the joint and thus of the support foot is obtained and the outward appearance of the walking aid is made more pleasant. Of course, an additional spring means may be inserted between the support plate and the support shaft or the adapter, apart from the hose-like elastic bellows. Yet this is not necessary if the elastic bellows extends far enough to the top to warrant that the relatively great pivoting motions of the support plate can be accommodated by relatively small and purely elastic deformations of the elastic bellows. The lifetime of the elastic bellows can be prolonged to almost any extent by varying the dimensions and the wall thickness of the bellows or by selecting a suitable material respectively. Furthermore, a suitable selection of the material of the support plate and of the sole body will provide a relatively small moment of inertia of the support foot and, consequently, the elastic bellows will be subjected to little stress anyhow.

The structural embodiment described above permits a very free choice of materials and this may be particularly advantageous under tribological aspects. Thus almost any pairing of materials may be employed in the range of the articulated connection. However, it was determined that fully sufficient values are obtained if the pairing polyethylene/polyethylene is chosen which is advantageous also for an economic production of the apparatus according to the invention. Further advantageous embodiments of the invention may be gathered from the remaining sub-claims.

The invention will be described further, by way of example, with reference to the accompanying drawings, in which:

FIG. 8 is a sectional view of a sole turn-over body having a profile at both sides;

FIG. 9 is a top or bottom plan view of the turn-over body shown in FIG. 8;

FIG. 10 is a sectional view of the support plate according to FIG. 7 designed to receive the sole and the ball end pin;

Figure 1:
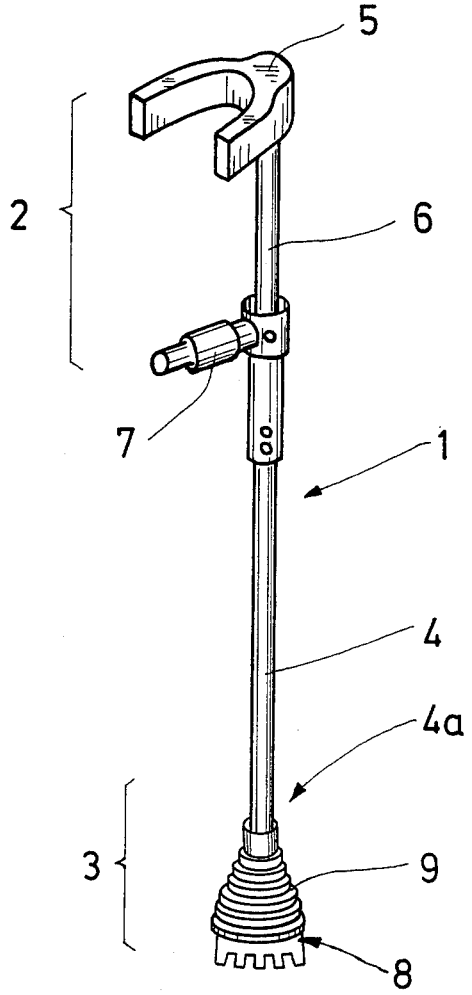
FIG. 1 is a perspective view of a walking aid, specifically a crutch including a support foot.

The crutch 1 shown in FIG. 1, in general, may be divided into an arm support means 2 and a ground contact portion 3. The arm support means is connected to the ground contact portion by a support shaft designed as a telescopic tube 4 so as to allow for adjustment of the length of the crutch 1. The arm support means 2 includes an armpit saddle 5 which is firmly anchored to an outer tube 6 and to which a handle bar 7 is connected so as to be adjustable. The ground contact portion 3 or that part of the crutch 1 contacting the ground is anchored firmly on the telescopic tube 4 and comprises a resilient shoe 8 which, as shown, for the embodiment of FIG. 1, is designed as a rubber-elastic sole supported at the foot section 4*a* of the support tube 4 of the crutch 1 by a support plate (not shown) which is covered by an elastic bellows 9.

Figure 2:
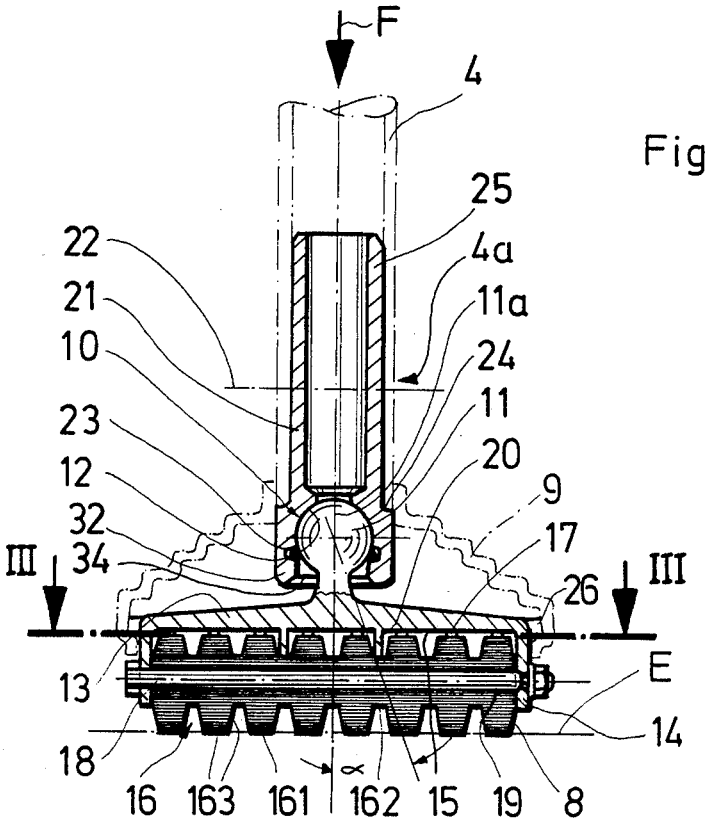
FIG. 2 is a longitudinal sectional view of an embodiment of the support foot of the crutch.
Figure 3:
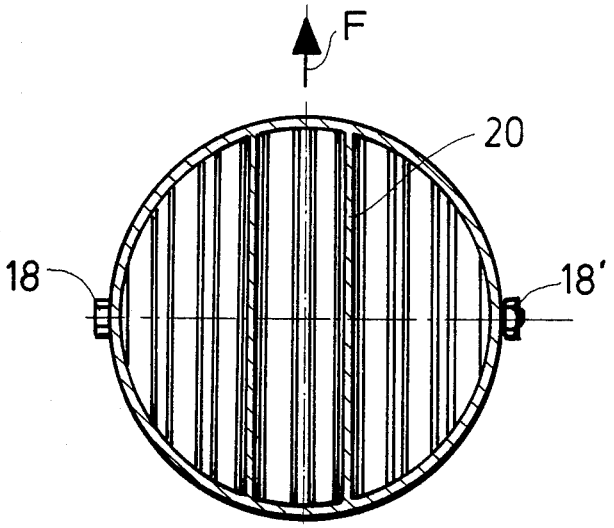
FIG. 3 is a sectional elevation of the support foot shown in FIG. 2 as seen in the direction of arrows III—III.

The elastic bellows shown in FIG. 1 covers an articulated connection means 10 embodied by a three-dimensional joint which has three degrees of freedom. FIG. 2 is a part sectional view of the support foot of the crutch 1 showing such an articulated means which, in the present case, is formed by a ball and socket joint comprising a ball end pin 11 and a socket 12. In this embodiment the ball end pin 11 is attached to the center of a support plate 13 in the form of a round plate which includes a bordering skirt 14 directed towards the bottom and serving as a universal plug socket for different sole bodies. The round plate 13 thus presents a receptacle which is defined along its entire circumference to take up the sole 8 of the support foot. The inside of the round plate 13 is plane so as to form a plane support face 15 for the rubber-elastic sole 8. In this embodiment the rubber-elastic sole is formed by a monoblock which is likewise circular in shape and consequently supported by the bordering skirt 14 along its entire circumference. The monoblock 8 has the outline of a cylindrical disc, preferably having a diameter of 60 mm and plane parallel faces. The jacket surface of the monoblock constitutes the guide section of the bordering skirt 14. Furthermore, the monoblock 8 has a profile surface 16 fitted with calks which, as seen in cross section, have the shape of a trapezoid. As the profile 16 is levelled, the outer faces 161 thereof all are disposed in one plane and are connected to the respective bases 162 by oblique faces 163. The counter E of the profile 16 is adapted to the support face 15.

In the embodiment shown in FIG. 2 the monoblock has identical profiles at both of its faces, one profile however being provided in the outer faces 161 with metal pins 17.

The monoblock is retained in the round plate 13 by means of a locking pin 18 penetrating diametrically through the round plate 13 and the core of the monoblock 8. To this end a steel sleeve 19 receiving the locking pin 18 is vulcanized into the core of the monoblock 8. The locking pin 18 essentially fulfills nothing but a function of securing the monoblock 8 as the latter under the action of a supporting force F abut against the support face 15 via the steel pins 17 or the profile faces 16 respectively, which are not in contact with the ground. As the locking pin 18 passes centrally through the core of the monoblock 8, the latter may simply be turned over if required by the conditions of the terrain without, however, changing anything in the principle of the support of the rubber-elastic sole at the support plate.

The embodiment shown in FIG. 2 includes supporting webs 20 which are attached or mounted at the inside support face 15 of the round plate 13 so as to engage with the profile 16 of the monoblock 8, thus supporting the monoblock by the inner faces 162 of the profile 16. The number of these support webs 20 and their arrangement with respect to each other may be adapted in correspondence with the respective profile used whereby the stress to which the monoblock 8 is subjected can be kept within relatively narrow limits. By virtue of these supporting webs 20 the monoblock 8 can be supported effectively and uniformly over a large surface area even if one side of the contour has become worn after a long period of use and the monoblock 8 has been turned over. Preferably the cross section of the supporting web 20 is adapted to the trapezoid clearance between the calks of the sectional outline 16.

In the embodiment shown in FIG. 2 the socket 12 of the ball and socket joint 10 is formed in an adapter 21 inserted into the lower section of the telescopic tube 4. The dash-dot line 22 in FIG. 2 indicates a releasable connection between the telescopic tube 4 and the adapter 21. Such a releasable connection, for instance, might be established by a fin splint or simply by a radial pin. If the adapter 21 is connected firmly to the telescopic tube 4 so as not to be releasable from the same, it is advantageous to provide a releasable connection between the ball end pin 11 and the socket 12 of the ball and socket joint 10. For this purpose the lower end portion 32 of the adapter 21 limiting the pivot angle movements of the neck of the ball end pin 11 by its internal circumference has a recess 34 adapted to the neck of the ball end pin 11 so that the round plate 13, in this specific alignment with this groove, can be pivoted through a release angle which is far greater than the normal pivot angle $\alpha$. If the ball of the ball end pin 11 is flattened at the top 11*a*, the ball end pin may be withdrawn from the socket 12 when in the far-swung uncoupling position. When in normal position, the ball is secured in the adapter 21 by a resilient locking ring 23. The adapter 21 is formed by a stepped tube the shoulder 24 of which receives the supporting force F and the centering section 25 of which receives the bending torques to be transmitted. As the telescopic tubes 4 of the crutches have standardized outer and inner diameters, different adapters 21 fit into each foot 4*a* of a crutch. Therefore, it is self-suggesting to offer the handicapped a plurality of adapters 21 with round plates secured to the same by the articulated connection means 10 and comprising monoblocks of different profiles. Thus all that has to be done by the handicapped is an exchange of the adapter by simple handling in order to adapt the walking aid to the respective requirements, i.e. the terrain or floor covering.

An elastic bellows 9 shown in discontinuous lines in FIG. 2 is provided so as to protect the articulated connection means 10 from the influence of dirt. On the one hand the bellows is connected in any suitable releasable manner either to the telescopic tube 4 or to the adapter 21 and, on the other hand, to the round plate 13, preferably the bordering skirt 14 thereof. The points of connection between the elastic bellows 9 and the round plate or the telescopic tube 4 or the adapter 21 must be tight so as to avoid for instance the entry of water or mud. To this end the adapter 21 or the telescopic tube 4 is tapped (not specifically shown), and an end portion of the elastic bellows 9 is pushed over the recess thus formed. Subsequently an elastic clamping means (likewise not shown) such as a hose clamp is placed around this end portion and tightened against the recess. On the other hand, the round plate 13 has a continuous circumferential retainer nose 26 which serves the same purpose and over which the other end portion of the elastic bellows 9 extends which is clamped against the bordering skirt 14 by another clamping means.

In FIG. 2 the pivot range to be realized by the articulated joint 10 is indicated in addition by the limit pivot angle $\alpha$. For example, this angle $\alpha$ may be 20° so that the support foot can be placed safely on the ground even when walking downhill in steep terrain.

Figure 4:
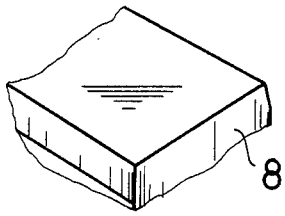
FIGS. 4 to 6 are perspective views of different profile designs of the monoblock used.
Figure 5:
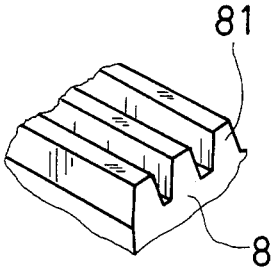
Figure 6:
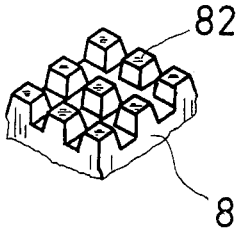

As already mentioned, it is not absolutely necessary for both face ends of the monoblock to have identical profiles 16. The further variants of profiles shown in FIGS. 4 to 6 each may be formed either at one side of the monoblock or at both sides thereof. These variants, furthermore, may be provided with steel pins or spikes. FIGS. 4 to 6 specifically show a smooth monoblock surface (FIG. 4), a calked profile such as already shown in FIG. 2 having calks 81 in the form of parallel bars of trapezoid cross section extending over the entire width of the monoblock 8 (FIG. 5) and a profile with calks in the form of truncated pyramids 82 which are arranged in a raster and formed over the entire face of the monoblock 8. The conical shape of the calks influences the adherence of dirt to the sole and, therefore, preferably should be between 6° and 8°.

Another equivalent structural solution of the articulated connection means 10 may be realized by a combination of a Cardan joint and a swivel joint which likewise guarantee the required degrees of freedom of the articulated connection means.

Possibilities of variation exist specifically as regards the design of the support plate which may be adapted in size and outline to the respective given requirements.

Moreover, the type of fixing of the monoblock 8 to the support plate may be replaced by a simple pin extending diametrically through the core range of the monoblock or by a plurality of locking pins driven radially from outside through the bordering skirt into the monoblock and secured by the effect of spreading.

Also the design of the monoblock 8 may be varied within wide limits so that optimum conditions of support can be obtained by suitable adaptation of the depth and width of the sectional outline and of the mutual support of the profile sections.

Another embodiment of the support foot of a walking aid in accordance with the invention will be described below. Identical or similar structural members of the subject matter of the application fulfilling the same function will be designated by the same reference numerals.

Figure 7:
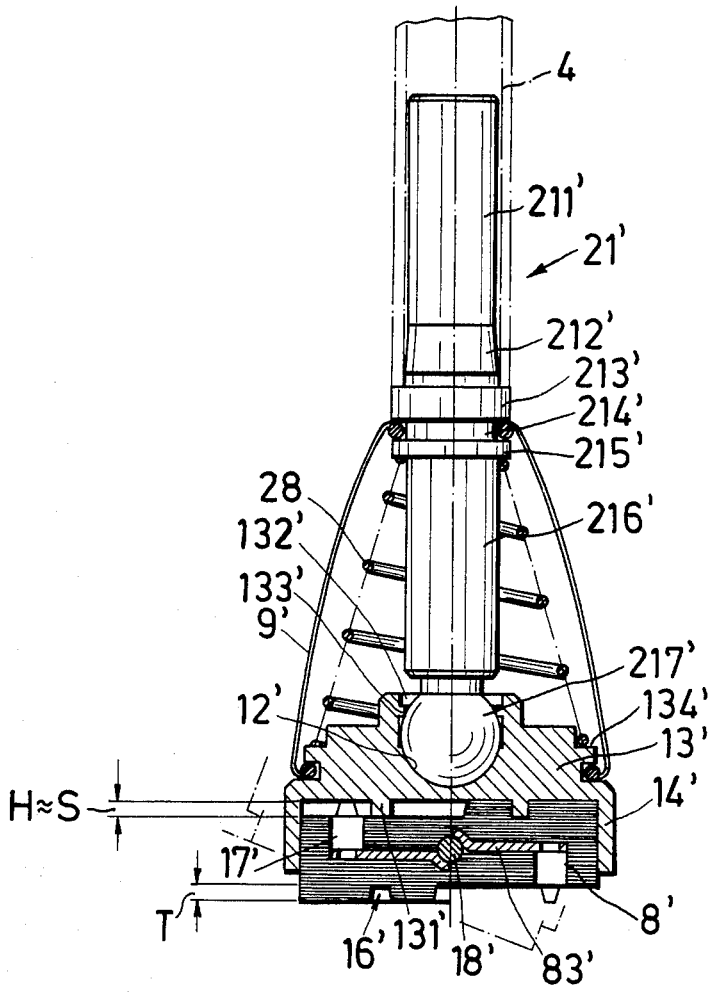
FIG. 7 is a sectional view similar to FIG. 2, showing another embodiment of the support foot of a walking aid, the turnover-sole thereof being shown in both its positions.

FIG. 7 diagrammatically shows in dash-dot lines a support tube 4 into which an adapter 21' is inserted, consisting of a shaft 211' to 216' with a ball end pin 217' attached to the same. The shaft specifically is composed of a cylindrical guide section 211', an adjacent conical clamping section 212', an abutment shoulder section 213', a tapped recess section 214', a shoulder section 215' and an adjacent shaft section 216'. The ball 217' of the ball end pin is in snap connection with the support plate 13' in which the socket or spherical segment 12' is formed, contrary to the embodiment described above. The support plate 13' shown in FIG. 7 likewise is designed as a round plate having a bordering skirt 14' which is directed towards the bottom. Thus the round plate 13' and the bordering skirt 14' constitute a receptacle closed all around for the sole 8' of the support foot so that again a universal plug socket is presented for different sole bodies.

The inside of the round plate 13' is substantially plane. Yet it comprises an annular web 131' which is concentric with the bordering skirt 14' and can be brought into engagement with a corresponding profiled section 16' of the sole 8'. The sole 8' shown in FIG. 7 is made of a block designed as a reversible or turnover body made of rubber-elastic material, as was the case with the embodiments described above. One side of the block 8' has a profile surface, while the other side may be plane or smooth, with steel pins or spikes 17' protruding from this surface. A metal plate 83' is vulcanized into the core of the rubber-elastic turn-over body 8', and a plurality of spikes 17' are fixed uniformly spaced along the circumference thereof. The metal pegs or spikes 17' protrude by a height S from the sole body 8', this dimension S corresponding to the profile depth T and substantially to the height H of the concentric annular web 131'.

The sole body 8' is fixed to the support plate 13' in the form of a round plate by a snap-type connection to be described in greater detail below. For this purpose pin ends project from the sole body 8' at diametrically opposed locations so as to be engaged with the bordering skirt 14' of the support plate 13'. Preferably, and as also shown in FIG. 7, the pin ends belong to a single locking pin 18' penetrating centrally through the turn-over sole 8' and passing through a central bore in the sole body 8'. It may be gathered from FIGS. 7 and 8 that the metal plate 83' reinforcing the sole body 8' is shaped such as to bypass the bore taking up the locking pin 18'. Thus by means of the locking pin 18' the sole body 8' is retained reliably against falling out or being drawn off from the support plate 13'. The right half of FIG. 7 shows the case in which the sole body 8' is supported on the ground by way of the spikes 17'. In this case force is transmitted to the support plate 13' by the annular web 131' as well as by the support face of the support plate 13'. The left half shows the turn-over body 8' in turned over position in which it is in contact with the ground by the profile surface 16'. In this case the force is transmitted to the support plate 13' substantially by way of the annular web 131' so that the metal pins 17' cannot become pressed into the support plate 13' even if the latter is made of relatively soft material, such as plastics and great forces are introduced.

The spherical segment 12' in the support plate 13' is adapted accurately to the ball end pin 217'. The entry opening 132' is formed with an annular collar 133' through which the ball end pin 217' is pressed so as to establish a secure joint connection and a snapping fit. The annular collar is dimensioned in height as well as internal diameter in consideration of the dimension of the ball 217', and the pairing of the material of the support plate 13' and of the ball end pin 217' is allowed for as well. The embodiment shown in FIG. 7 may be realized in advantageous manner by a pairing of materials of polyethylene/polyethylene.

In the embodiment according to FIG. 7 the support plate 13' receiving the sole body 8' is designed specifically in various respects to be described in greater detail with reference to FIG. 10. Above the bordering skirt 14' the support plate 13' presents not only a radial flange 134' but also an adjacent tapped annular recess 135'. The radial flange 134' serves as support face for a stabilizing spring 28 which is supported at its other end at the underside of the shoulder section 215' of the adapter 21'. The annular recess 135' takes up an elastic bellows 9' which extends as far as the tapped section 214' of the adapter 21'. The elastic bellows 9' provides effective shielding of the articulated connection means between the adapter 21' and the support plate 13' from the surroundings, i.e. from dirt. It was found that with suitable dimensioning of the elastic bellows, such as shown in fig. 7, the stabilizing spring 28 may be dispensed with. The bellows 9' alone, being of relatively great height, is quite apt to accommodate pivoting motions of the support plate 13' by deforming elastically.

Figure 12:
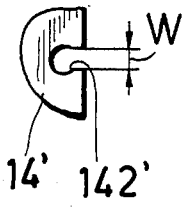
FIG. 12 is a partial view of the support plate shown in FIGS. 10 and 11, as seen in the direction of arrow XII.
Figure 11:
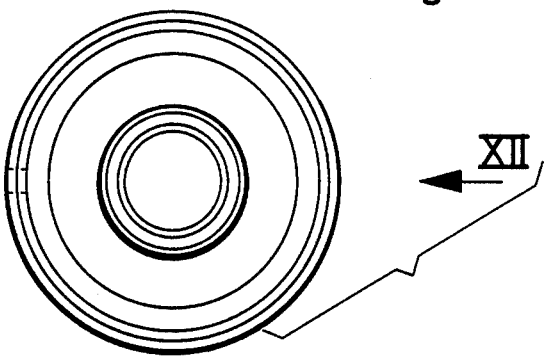
FIG. 11 is a top plan view of the support plate shown in FIG. 10.

As may be taken from FIG. 10, the bordering skirt 14' is provided at diametrically opposed areas with an insert hole 141' defined all around and, on the other hand, with a clamping slot opening 142' which is open in downward direction, as indicated in FIG. 12. The diameter D of the insert hole 141' corresponds to the diameter of the locking pin 18' engaging in this hole. The width W of the clamping slot opening 142' is somewhat smaller so that the locking pin 18' may snap into the clamping slot opening 142'. Preferably, the locking pin 18' is formed at the end entering into engagement with the clamping slot opening 142' with an enlarged gripping head (not shown) so as to facilitate the introduction or pushing out of the same. Rather minor forces acting on the enlarged gripping head will cause the locking pin 18' to snap out of the clamping slot opening 142' whereupon the turn-over body 8' may be turned or removed from the support plate 13' by slight displacement, i.e. pulling the other end of the pin out of the insert hole 141'.

FIG. 8 shows another embodiment of the rubber elastic sole body 8' shown in FIG. 7 and designed as a turn-over body. In this particular embodiment both sides of the sole body 8' have identical profiles 16'. A metal plate 83' again is vulcanized in the central plane 84' where also the passage opening 85' for the locking pin 18' is located.

Figure 13:
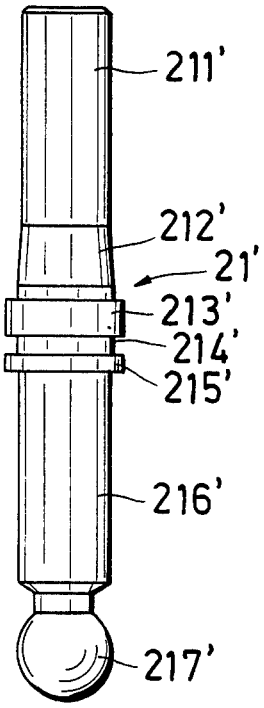
FIG. 13 is an elevational view of the ball end pin shown in FIG. 7.

FIG. 13 is another specific presentation of the configuration of the adapter 21' shown in FIG. 7. It is not necessary to describe this figure in detail since the essential elements of the adapter 21' are described with reference to FIG. 7.

Figure 14:
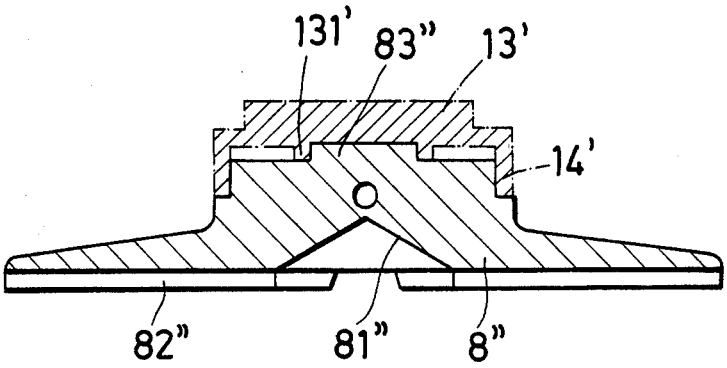
FIG. 14 is a sectional elevation of an embodiment of the support foot sole designed as a "field plate"
Figure 15:
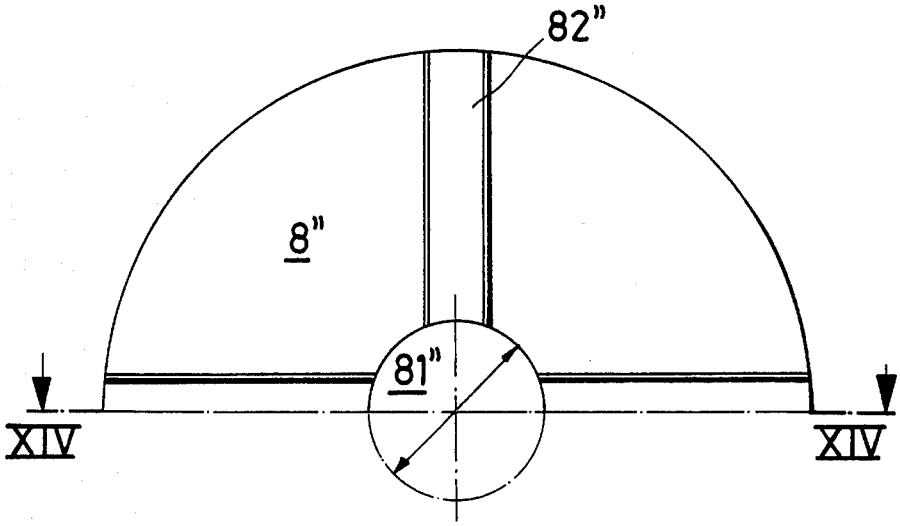
FIG. 15 is a simplified view from below of the "floor plate" shown in FIG. 14.

FIGS. 14 and 15 show another embodiment of a sole body adapted to be fit into the bordering skirt. The sole body 8'' shown in FIGS. 14 and 15 serves as a "recreation or field plate". The lower portion of the support plate 13' and of the bordering skirt 14' formed integral with the same is indicated by dash-dot lines. The "field plate" 8'' is centered with respect to the support plate 13' and connected in form lock to the same by the bordering skirt 14' and the annular web 131'. The sole body 8'' is designed as a round plate which projects radially beyond the bordering skirt 14' and is formed at its underside with a funnel-shaped recess 81'' and a plurality of sectional grooves 82''. The sole body 8'' is fixed to the support plate 13' either simply by the snap-type connection described above and consisting of a locking pin, an insert hole, and a clamping slot opening and/or by a retaining pin (not shown) which extends diametrically through the sole body 8'' and penetrates the bordering skirt 14' at both sides, being locked in this penetrating position. With the embodiment according to FIGS. 14 and 15 the supporting force is transmitted directly to the central area of the support plate 13' by way of the bordering skirt 14', the annular web 131' and, if desired, a centering butt end 83''.

Preferred materials for the adapter 21', the support plate 13', and the sole body 8'' are plastic materials adapted for injection molding, such as polyolefins, preferably polyethylene (PE), particularly heigh density polyethylene (HDPE).

Thus the invention provides a support foot for walking aids, particularly crutches, comprising a sole body which is fixed to a support plate anchored in articulated fashion to the support shaft. The support plate comprises a bordering skirt which serves as a universal plug socket for a standardized guide section of different sole bodies which are safely and releasably held in the bordering skirt by fastening means passing through the same. The design of the support foot is such that it gives the handicapped a degree of safety not attained before and further permits a conventional walking aid to be modified at very little expenditure such that it will be adapted in optimum manner to the respective surroundings. Various modifications in structure and/or function may be made to the disclosed embodiments by one skilled in the art without departing from the scope of the invention as defined by the claims.

What we claim is:

1. A resilient support foot for a walking aid comprising:

a resilient sole body having a first surface for establishing contact with the ground;

a support plate having a bordering skirt and a support plate face, the sole body being loosely fitted within the skirt, the skirt providing lateral support for the sole body;

a second sole body surface remote from the first surface cooperating with the plate face to support the sole body;

universal joint means for linking the support plate to a support shaft of the walking aid; and fastening means for releasably securing the sole body within the skirt, the fastening means penetrating through the skirt and through the sole body.

2. The support foot as claimed in claim 1, wherein the bordering skirt is designed as a hollow cylinder in which an external guide section of the sole body is received in snug fit.

3. The support foot as claimed in one of claims 1 or 2, wherein the fastening means are embodied by at least one pin penetrating the bordering skirt.

4. The support foot as claimed in one of claims 1 or 2, wherein the sole body disposed in facial abutment against the support plate is snapped releasably in the bordering skirt of the support plate, the snap fit being provided by at least two diametrically opposed pin ends of the fastening means for which the bordering skirt is formed with an annularly defined insert hole and a downwardly open clamping slot opening.

5. The support foot as claimed in claim 4, wherein the pin end for the clamping slot opening is formed with an enlarged gripping head.

6. The support foot as claimed in claim 4, wherein the sole body is designed as a turn-over body and the pin ends lie in the central plane of the turn-over body and are constituted by the ends of a single throughgoing locking pin.

7. The support foot according to claim 4 wherein the support plate is a round plate and includes on its support face for the engagement with an annular web a corresponding recess at the sole body.

8. The support foot according to claim 4 wherein one-half of the universal joint means is formed in an adapter which is secured against rotation and displacement in the support shaft, the adapter being releasably connected to the support shaft.

9. The support foot as claimed in one of claims 1 or 2, wherein one joint half of the joint means is formed in an adapter which is secured against rotation and displacement in the support shaft of the walking aid, wherein the adapter is connected releasably to the support shaft.

10. The support foot as claimed in claim 9, wherein the support plate includes, at its upper face, a hemispherical snap-in socket for receiving releasably, a ball end pin.

11. The support foot as claimed in claim 10, wherein the ball end pin and its shaft are made of polyethylene.

12. The support foot according to claim 9 wherein a stabilizing spring means is provided between the support plate and the support shaft or adapter, respectively.

13. The support foot as claimed in one of claims 1 or 2, wherein a stabilizing spring means is provided between the support plate and the support shaft.

14. The support foot as claimed in claim 13, wherein the spring means is a hose-like elastic bellows shielding the joint means from the surroundings.

15. The support foot as claimed in claim 1 or 2, wherein the sole body being a rubber-elastic block is designed as a turn-over body having at both sides a profile provided with calks the contour of which is adapted to the support face of the support plate.

16. The support foot as claimed in claim 15, wherein one of the calked profiles which each are levelled is provided with steel pins or spikes but otherwise identical with the other sectional outline.

17. The support foot according to claim 16 wherein the support plate is furnished at its underside with at least two spaced or crossed support webs engaging with the calked profile of the rubber-elastic block and by means of which said body is supported on the support plate.

18. The support foot as claimed in claim 15, wherein the support plate is furnished at its underside with at least two spaced or crossing support webs engaging with the calked profile of the rubber-elastic block and by means of which said body is supported on the support plate.

19. The support foot according to claim 18 wherein the fastening means are embodied by at least one pin penetrating the bordering skirt.

20. The support foot according to claim 18 wherein the support plate with its bordering skirt is designed as an axially symmetrical support plate, the rubber-elastic block being secured by a locking pin extending diametrically through the support plate and penetrating the central core of the block, a steel sleeve being vulcanized in the block to receive the locking pin.

21. The support foot according to claim 18 wherein the sole body is disposed in facial abutment against the support plate and is releasably snapped into the bordering skirt, the snap fit being provided by at least two diametrically opposed pin ends of the fastening means for which the bordering skirt is formed with an annularly defined insert hole and a downwardly open clamping slot opening.

22. The support foot as claimed in claim 15, wherein the support plate with its bordering skirt is designed as an axially symmetrical support plate, wherein the rubber-elastic block is secured by a locking pin extending diametrically through the support plate and penetrating the central core of the rubber-elastic block, a steel sleeve being vulcanized in the rubber-elastic block to receive the locking pin.

23. The support foot as claimed in claim 22, wherein the rubber-elastic block has the form of a cylindrical disc, wherein the disc diameter is approximately 60 mm.

24. The support foot according to claim 22 wherein the sole body is disposed in facial abutment against the support plate and is releasably snapped into the bordering skirt, the snap fit being provided by at least two diametrically opposed pin ends of the fastening means for which the bordering skirt is formed with an annularly defined insert hole and a downwardly open clamping slot opening.

25. The support foot as claimed in claim 22, wherein the support plate, being designed as a round plate, includes on its support face for the engagement with an annular web a corresponding recess at the sole body.

26. The support foot as claimed in claim 25, wherein the depth of profile of the sole body corresponds to the height of the annular web.

27. The support foot as claimed in claim 25 wherein the sole body, being designed as a turn-over body, is provided at one side with spikes the height of which corresponds to the depth of profile and which are fixed to a metal plate vulcanized in the material.

28. The support foot as claimed in claim 2 or 1 wherein the sole body is designed as a round plate projecting radially beyond the bordering skirt and made of plastics, for example polyethylene, and including, at its underside, a funnel-shaped recess from which profile grooves lead to the outside.

29. The support foot as claimed in claim 27 wherein an additional diametrically extending locking pin for fixing to the bordering skirt and by a centering butt end engaging with the annular web.

30. The support foot according to claim 1 wherein the bordering skirt comprises a universal socket to receive a standardized sole body.

31. The support foot according to claim 28 wherein one joint half of the joint means is formed on an adaptor which is secured against rotation and displacement in the support shaft, the adaptor being releaseably connected to the support shaft.

32. The support foot according to claim 4 wherein the sole body is designed as a round plate projecting radially beyond the bordering skirt and made of plastic, for example polyethylene, and including, at is underside, a funnel-shaped recess from which profile grooves lead to the outside.

* * * * *